US007748144B2

(12) United States Patent
Denfeld

(10) Patent No.: US 7,748,144 B2
(45) **Date of Patent: *Jul. 6, 2010**

(54) VEHICLE SHAPED FOOTWEAR

(76) Inventor: Pamela Denfeld, 11280 NW. East Rd., Portland, OR (US) 97229-2500

( * ) Notice: Subject to any disclaimer, the term of this patent is extended or adjusted under 35 U.S.C. 154(b) by 868 days.

This patent is subject to a terminal disclaimer.

(21) Appl. No.: 11/553,169

(22) Filed: Oct. 26, 2006

(65) Prior Publication Data

US 2007/0089320 A1 Apr. 26, 2007

Related U.S. Application Data

(60) Provisional application No. 60/596,859, filed on Oct. 26, 2005.

(51) Int. Cl.
*A43B 23/00* (2006.01)

(52) U.S. Cl. ..... 36/112; 36/137; 36/139; 362/103; D2/897

(58) Field of Classification Search ..... 36/112, 36/136, 137, 139; D2/897–899; 362/103
See application file for complete search history.

(56) References Cited

U.S. PATENT DOCUMENTS

D158,520 S * 5/1950 Scoville, Jr. ..... D2/898
D165,014 S * 10/1951 Leslie ..... D2/898
3,396,480 A * 8/1968 Sherman ..... 36/112
D217,532 S * 5/1970 Sherman ..... D2/898
D240,973 S * 8/1976 Tesky ..... D2/898
D240,974 S * 8/1976 Tesky ..... D2/898
D258,698 S * 3/1981 Cohen ..... D2/898
D261,195 S * 10/1981 Weiss ..... D2/898
D283,462 S * 4/1986 Whitman ..... D2/898
D294,765 S * 3/1988 Otto ..... D2/898
D307,507 S * 5/1990 Del Vecchio et al. ..... D2/898
D343,948 S * 2/1994 Smith ..... D2/977
D352,380 S * 11/1994 Oehring et al. ..... D2/898
D353,706 S * 12/1994 Telles ..... D2/898
5,381,615 A 1/1995 MacMillan
D356,434 S * 3/1995 Englehart, Jr. ..... D2/898
5,461,188 A * 10/1995 Drago et al. ..... 84/600
5,500,635 A 3/1996 Mott
D375,613 S * 11/1996 Humphrey ..... D2/897
D375,828 S * 11/1996 DeLangie ..... D2/898
5,649,376 A * 7/1997 Lecates, Jr. ..... 36/137
D394,137 S * 5/1998 Nadel ..... D2/898
5,765,300 A * 6/1998 Kianka ..... 36/139
5,921,674 A 7/1999 Koczi
6,017,128 A 1/2000 Goldston et al.
D419,754 S * 2/2000 Vectirelis, Jr. ..... D2/898
D434,546 S * 12/2000 Zelenack ..... D2/898
D434,893 S * 12/2000 Blanco ..... D2/898
6,293,032 B1 * 9/2001 Waits ..... 36/137

(Continued)

FOREIGN PATENT DOCUMENTS

FR 2643794 A1 * 9/1990

*Primary Examiner*—Marie Patterson
(74) *Attorney, Agent, or Firm*—Novak Druce DeLuca + Quigg LLP

(57) ABSTRACT

Children's footwear configured to have the appearance of a motor vehicle. The footwear has a light emitting device, a sound emitting device, and a remote transmitter for controlling the light emitting device and the sound emitting device. The footwear may come in a variety of motor vehicle appearances.

30 Claims, 3 Drawing Sheets

U.S. PATENT DOCUMENTS

D450,174 S * 11/2001 Scotti ..... D2/898
6,315,571 B1 * 11/2001 Lee ..... 434/250
6,789,913 B2 9/2004 Wei
7,114,822 B2 * 10/2006 Guzman ..... 362/103
7,178,929 B2 2/2007 Guzman
7,181,870 B2 2/2007 Guzman
7,254,910 B2 * 8/2007 Guzman ..... 36/136
2001/0004808 A1 * 6/2001 Hurwitz ..... 36/137
2004/0159022 A1 8/2004 Winford et al.
2005/0150139 A1 7/2005 Guzman
2005/0183294 A1 8/2005 Guzman
2006/0007670 A1 * 1/2006 Chien ..... 362/103
2006/0090375 A1 5/2006 Chen
2007/0006489 A1 * 1/2007 Case et al. ..... 36/132

* cited by examiner

VEHICLE SHAPED FOOTWEAR

CROSS-REFERENCE TO RELATED APPLICATION AND CLAIM FOR PRIORITY

This application claims priority under 35 U.S.C. §119(e) of Provisional Application Ser. No. 60/596,859 filed Oct. 26, 2005.

BACKGROUND DESCRIPTION

1. Technical Field

This invention pertains generally to footwear incorporating lighting and sound circuitry, and more particularly to an article of footwear for children, which is shaped like a vehicle, incorporating a multiple switch controlled lighting and sound circuit.

2. Background of the Invention

Footwear having lighting and sound circuitry is well known. Lighting and sound devices have been incorporated into a variety of footwear, including dress shoes, athletic shoes, boot, sandals, etc. Footwear shaped like a vehicle is also known.

There are several known implementations of footwear lighting devices. The most basic implementation involves the use of a light source (e.g. an incandescent bulb, a neon tube, or a light emitting diode ("LED")), a portable power supply such as a battery and a manually operated on-off switch. These elements are connected as an electric circuit and are located in a convenient location in the footwear, such as within the sole and/or heel structure.

A more complex implementation of lighted footwear includes the provision of a switching circuit to switch the light on and off in association with the presence of the absence of the wearer's foot in the shoe or the contact of the wearer's foot with the ground.

A third implementation involves the use of a so-called "motion switch" that is utilized to detect movement of the wearer's foot. The detection of movement causes the light to illuminate. Such a "motion switch" usually involves the use of a "tilt switch," i.e. a mercury switch, to sense the angular position of the shoe with respect to the gravity gradient to activate the circuit at a particular attitude of the switch.

There are also known implementations of providing sound in footwear. One such implementation incorporates a loud speaker with is triggered by an electrical switch. The sound can be an excerpt from a commercial recording, a voice element, or an instrumental element.

It is desirable to have footwear that incorporates both the lighting element and the sound element in one shoe. It is further desirable to have such footwear where the lighting and sound elements may be user controlled. Finally it is desirable to have footwear shaped like a vehicle that incorporates these elements.

SUMMARY OF THE INVENTION

This invention therefore provides for a shoe with a body configured to have the appearance of a motor vehicle. The shoe has a light emitting device and a sound emitting device provided on the body. The light emitting device and the sound emitting device may be controlled by a remote transmitter. The body may be configured to appear like one of a variety of different motor vehicles. Furthermore, the sound emitting device may produce a variety of motor vehicle like sounds as well as spoken words.

In another embodiment the light emitting device and the sound emitting device may be controlled by a controller within the body of the shoe. The controller may consist of a vibration sensor that activates the light emitting device and/or the sound emitting device when a certain level of vibration is reached.

BRIEF DESCRIPTION OF THE DRAWINGS

The invention will now be described in greater detail in the following by way of example only and with reference to the attached drawings, in which.

DETAILED DESCRIPTION OF THE INVENTION

The present invention provides footwear, e.g. shoes, boots, sneakers, skates, etc. for children that have the appearance of motor vehicles, such as cars, trucks, fire engines, ambulances, police vehicles, etc. Herein, any and all such footwear will be referred to as a "shoe" for purposes of simplicity.

Figure 1:
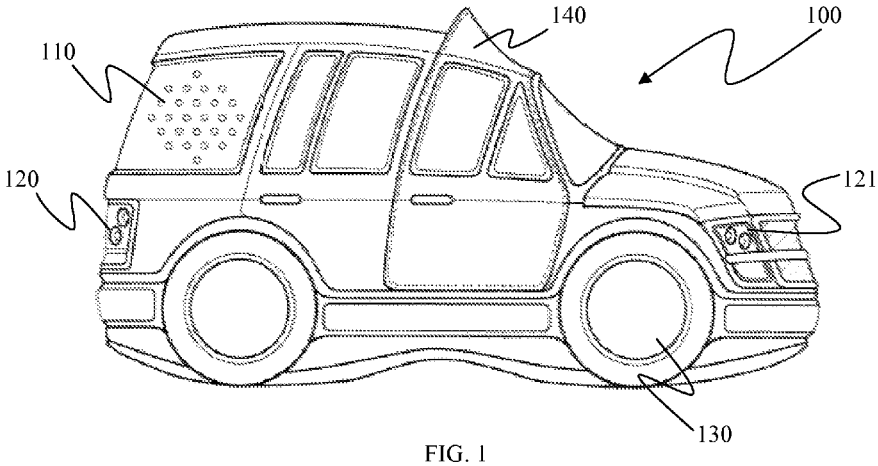
FIG. 1 is a side view of one embodiment of the present invention.
Figure 2:
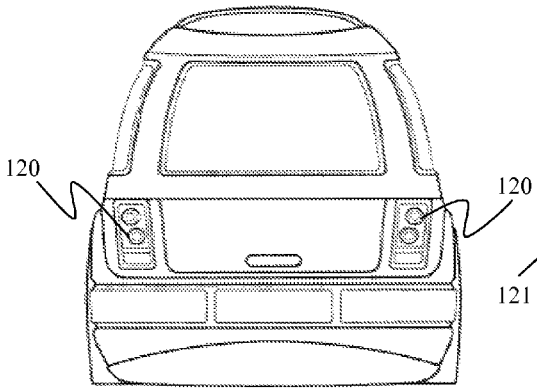
FIG. 2 is a back view of one embodiment of the present invention.
Figure 3:
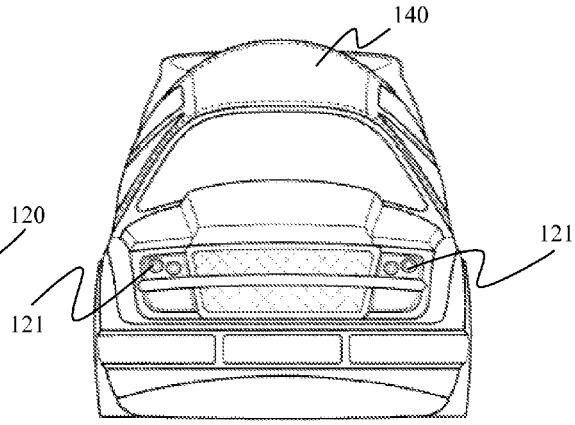
FIG. 3 is a front view of one embodiment of the present invention.

FIGS. 1-3 are the side, back and front views, respectfully, of a sports utility vehicle embodiment of the shoe 100. The shoe may consist of a body into which the child places his or her foot, a securable flap 140 to hold the child's foot in the shoe, light emitting devices 120 and 121, and/or a sound emitting device 110. The body of the shoe 100 is configured to resemble a motor vehicle and, as such, has many aspects found in motor vehicles, such as wheels 130, head lights 121, tail lights 120, a hood, etc. The wheels 130 may be illustrated or may be actual toy wheels attached to the shoe 100.

The shoe 100 is accessed by one or more flaps 140, corresponding to a car door, hood or trunk. Each flap may be removably secured to the main body of the shoe 100 by a suitable securing mechanism, e.g. Velcro. In alternate embodiments, however, the shoe may be a slip-on, resembling a flatbed or pickup truck, in which case no flap may be needed and "entrance" may be from the "bed" of the shoe, or may be a high-top shoe resembling an SUV (Sport Utility Vehicle), wherein the "entrance" may be from the top, or "roof" of the shoe.

The lights 120 and 121, which may be low power low voltage light sources such as LEDs, LCDs, etc. are mounted in the shoe 100 at locations corresponding to the location of head light, tail lights, turn signal blinkers, and/or flashers on real motor vehicles. The lights 120 and 121 may be controlled by a remote transmitter 600 (see FIG. 6 described below), an in shoe controller (not shown) and/or an optional vibration sensor 727 (see FIG. 7 described below).

Additionally the footwear may be provided with a sound emitting device 110. The sound emitting device may produce various vehicle related sounds, such as a honk, an engine rev, a siren, a tire screech, etc. In addition to vehicle related sounds, the sound emitting device may produce spoken words or phrases, thereby giving each type of footwear a different "personality." The sounds may be controlled by a remote transmitter 600 (see FIG. 6 described below), an in shoe controller (not shown) and/or an optional vibration sensor 727 (see FIG. 7 described below). A sound producing device may be provided in one shoe or both shoes. Alternately, the sound producing device may be provided in the remote transmitter itself, and possibly correlated with corresponding light signals provided to the shoe. For example, a screeching sound emanating from the remote transmitter may be correlated with brake or warning lights; a horn sound may be correlated with flashers or headlights, etc.

Figure 4:
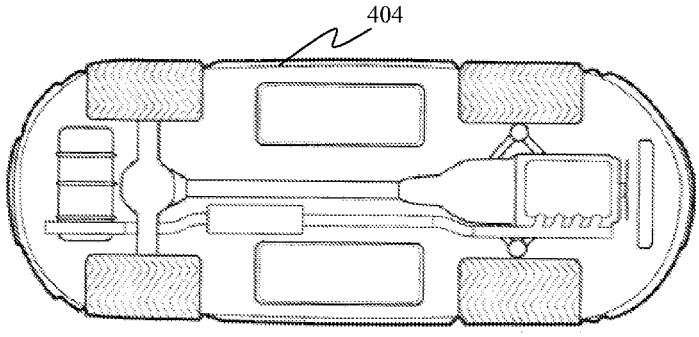
FIG. 4 is a bottom view of one embodiment of the present invention.

FIG. 4 is a bottom view of an embodiment of the shoe 100. Each shoe may have a picture 404 printed on the bottom that resembles the under carriage of a vehicle. The picture may be covered with a clear rubber to provide traction.

Figure 5:
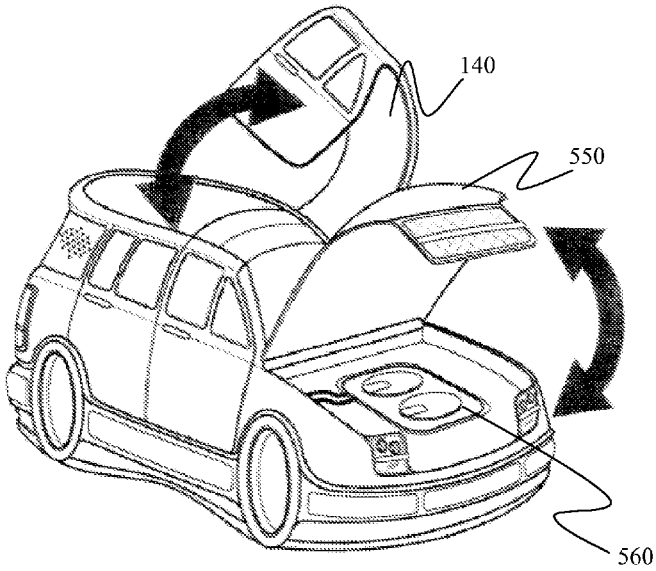
FIG. 5 is a perspective view of one embodiment of the present invention showing the flaps in the open position.

FIG. 5 is a perspective view of the shoe 100 with the flaps 140 and 550 in the open position. When the door flap 140 is open the child can easily slip his or her foot into the shoe 100. The door flap 140 may then be closed and secured by a suitable securing mechanism, e.g. Velcro. The hood flap 550 may conceal the battery holder 560 that supplies power to the light emitting devices 120 and 121 and the sound emitting device 110. The hood may also conceal an IR receiver 757 (see FIG. 7 discussed below) and the circuit wiring.

Figure 6:
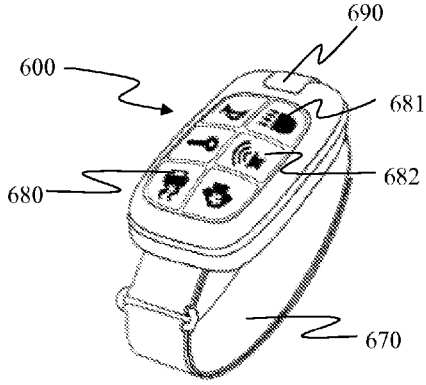
FIG. 6 is a perspective view of one embodiment of the remote transmitter.

FIG. 6 is a perspective view of one embodiment of the remote transmitter 600. The remote transmitter 600 may have a band 670 that allows it to be securely fastened to the shoe wearer's arm. The band 670 may be secured by a suitable securing mechanism, e.g. Velcro. The remote transmitter 600 may consist of one or more buttons 680-682 that control the light emitting devices 120 and 121, the sound emitting devices 110, or a combination of the two. For example pressing button 681 may turn on the head lights, pressing button 682 may sound the horn, and pressing button 680 may turn on the break lights and cause the sound emitting device to emit a tire screeching sound.

Furthermore, the remote transmitter 600 may be provided with an IR transmitter 690 to send messages to the shoe 100 via the IR receiver 757 in the shoe 100. The remote transmitter 600 may also have a cover (not shown) corresponding to the type of vehicle with which it is associated, such as a checkered flag design in conjunction with a race car.

In an alternate embodiment, the lights and/or sounds may be controlled by a controller provided in the shoe 100 itself. The controller may be activated by certain motions of a wearer such as tapping or contacting the ground or floor with a certain part of the shoe.

Figure 7:
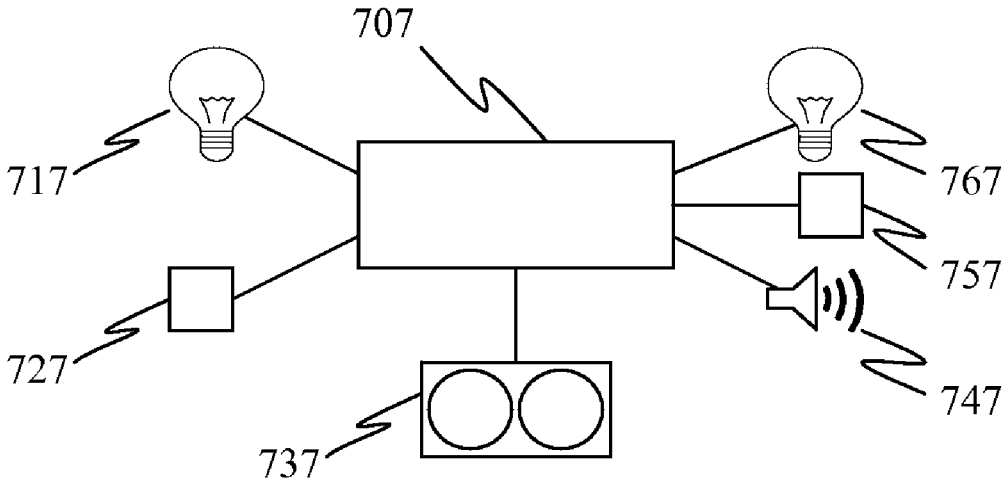
FIG. 7 is a schematic diagram of the circuitry of one embodiment of the present invention.

FIG. 7 is a schematic diagram of an embodiment of the circuitry for the shoe 100. The circuitry may consist of a circuit board 707. The circuit board 707 may be attached to a tail light 717, a head light 767, a vibration sensor 727, an IR detector 757, a sound emitting device 747, and/or a power source 737. Additional attachments, such as additional light emitting devices, may be added to the circuit board 707 as needed.

As required, disclosures herein provide detailed embodiments of the present invention; however, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

What is claimed is:

1. A shoe, comprising:

a body configured to have the appearance of a motor vehicle, including at least a plurality of body elements resembling tires;

a light emitting device provided on the body;

a sound emitting device provided on the body; and wherein the light emitting device and the sound emitting device are controlled by a remote transmitter, to provide lights and sounds that emulate operation of a motor vehicle.

2. The shoe of claim 1, further comprising a power source, wherein the light emitting device, the sound emitting device and the power source are connected to a circuit board.

3. The shoe of claim 2, further comprising an IR detector connected to the circuit board.

4. The shoe of claim 3, wherein the remote transmitter further comprises an IR transmitter.

5. The shoe of claim 2, further comprising a vibration sensor connected to the circuit board.

6. The shoe of claim 1, wherein the body has at least one securable flap for facilitating access to a wearer's foot into the shoe, said at least one flap corresponding to one of a door, hood and trunk of the motor vehicle.

7. The shoe of claim 2, further comprising a securable flap that conceals at least said power source, said securable flap corresponding to a hood or a trunk of the motor vehicle.

8. The shoe of claim 1, wherein the remote transmitter is adapted to be worn on the user's wrist.

9. The shoe of claim 1, wherein the light emitting device corresponds to at least one of a headlight, turn signal, and emergency flashing light.

10. The shoe of claim 8, wherein the light emitting device is an LED.

11. The shoe of claim 8, wherein the light emitting device is an LCD.

12. The shoe of claim 8, wherein the light emitting device is a light bulb.

13. The shoe of claim 1, wherein the sound emitting device produces a horn sound.

14. The shoe of claim 1, wherein the sound emitting device produces a tire screeching sound.

15. The shoe of claim 1, wherein the sound emitting device produces an engine revving sound.

16. The shoe of claim 1, wherein the sound emitting device produces a siren sound.

17. The shoe of claim 1, wherein the sound emitting device produces spoken words.

18. A shoe, comprising:

a body configured to have the appearance of a motor vehicle, including at least a plurality of body elements resembling tires;

a light emitting device provided on the body;

a sound emitting device provided on the body; and a controller provided within the body for controlling the light emitting device and the sound emitting device to provide lights and sounds that emulate operation of a motor vehicle.

19. The shoe of claim 18, further comprising a vibration sensor connected to the controller, whereby said controller controls operation of at least one of said light emitting device and said sound emitting device in response to a signal received from said vibration sensor.

20. The shoe of claim 18, wherein the body has at least one securable flap for facilitating access to a wearer's foot into the shoe.

21. The shoe of claim 20, wherein the flap corresponds to one of a door, hood and trunk of the motor vehicle.

22. The shoe of claim 18, wherein the light emitting device corresponds to at least one of a headlight, turn signal, and emergency flashing light.

23. The shoe of claim 22, wherein the light emitting device is an LED.

24. The shoe of claim 22, wherein the light emitting device is an LCD.

25. The shoe of claim 22, wherein the light emitting device is a light bulb.

26. The shoe of claim 18, wherein the sound emitting device produces a horn sound.

27. The shoe of claim 18, wherein the sound emitting device produces a tire screeching sound.

28. The shoe of claim 18, wherein the sound emitting device produces an engine revving sound.

29. The shoe of claim 18, wherein the sound emitting device produces a siren sound.

30. The shoe of claim 18, wherein the sound emitting device produces spoken words.

* * * * *

UNITED STATES PATENT AND TRADEMARK OFFICE

CERTIFICATE OF CORRECTION

PATENT NO. : 7,748,144 B2
APPLICATION NO. : 11/553169
DATED : July 6, 2010
INVENTOR(S) : Pamela Denfeld It is certified that error appears in the above-identified patent and that said Letters Patent is hereby corrected as shown below:

Title Page, (*) Notice:
The statement concerning a Terminal Disclaimer is in error and is deleted. This patent is not subject to any terminal disclaimer Signed and Sealed this Seventh Day of September, 2010

David J. Kappos

David J. Kappos
*Director of the United States Patent and Trademark Office*